US007331300B2

(12) United States Patent
Back

(10) Patent No.: US 7,331,300 B2
(45) Date of Patent: Feb. 19, 2008

(54) QUILT PATCH BRAIDED RUGS AND METHOD FOR MAKING THE SAME

(75) Inventor: Edward Back, Little Rock, AR (US)

(73) Assignee: Capitol Importing Company, Inc., Little Rock, AR (US)

( * ) Notice: Subject to any disclaimer, the term of this patent is extended or adjusted under 35 U.S.C. 154(b) by 16 days.

(21) Appl. No.: 11/226,475

(22) Filed: Sep. 14, 2005

(65) Prior Publication Data

US 2007/0028818 A1 Feb. 8, 2007

Related U.S. Application Data

(60) Provisional application No. 60/699,592, filed on Jul. 15, 2005.

(51) Int. Cl.
*D05B 23/00* (2006.01)
*D04H 3/00* (2006.01)

(52) U.S. Cl. ..... 112/475.08; 112/9; 428/37

(58) Field of Classification Search ..... 112/9, 112/7, 439, 441, 420, 475.08, 153, 152, 470.25, 112/470.33, 475.04; 28/143; 87/3, 7, 8; 428/37; D06/582, 592
See application file for complete search history.

(56) References Cited

U.S. PATENT DOCUMENTS 1,381,832 A * 6/1921 Heidenheim ..... 28/143
1,564,036 A * 12/1925 Waite ..... 87/8
1,591,902 A * 7/1926 Weinberg ..... 424/411
1,883,438 A * 10/1932 Adams ..... 428/397
1,923,551 A * 8/1933 Murphy ..... 428/37
2,473,024 A * 6/1949 Gregg ..... 12/146 B
3,098,281 A * 7/1963 Flitterman ..... 428/37
3,153,366 A * 10/1964 Iwai ..... 87/7
3,505,154 A * 4/1970 James ..... 428/37
3,635,653 A 1/1972 Snider et al.
3,694,873 A 10/1972 Crowley
3,723,811 A 3/1973 Koeleveld
3,735,537 A 5/1973 Panker
3,839,135 A 10/1974 Lowry et al.
3,847,719 A 11/1974 Crowley (Continued)

FOREIGN PATENT DOCUMENTS

JP 2000017553 A * 1/2000

OTHER PUBLICATIONS

Natural Area Rugs, http://web.archive.org/web/20050105090655/http://www.naturalaarearugs.com/ . . . (Jan. 5, 2005).*

(Continued)

*Primary Examiner*—Ismael Izaguirre
(74) *Attorney, Agent, or Firm*—Speed Law Firm; Kyla D. Cummings; Gary N. Speed

(57) ABSTRACT

Embodiments include a floor covering comprising one or more patches, wherein each patch comprises one or more braids of jute-like fibers. In one aspect, at least one of the braids is wrapped around itself to form a first patch. In another aspect, the first patch is operatively connected to a second patch. In one embodiment, the floor covering resembles a quilt. Further embodiments include a method for forming the floor covering.

26 Claims, 5 Drawing Sheets

U.S. PATENT DOCUMENTS 3,862,874 A * 1/1975 Hopper et al. ..... 428/47
3,871,661 A 3/1975 Korff
3,905,100 A 9/1975 Kleine et al.
4,100,835 A * 7/1978 Kozlowski ..... 87/1
4,336,289 A 6/1982 Davis
4,646,666 A * 3/1987 Burrier ..... 112/475.22
4,949,415 A * 8/1990 Selga ..... 5/502
5,367,965 A 11/1994 Earnhardt
6,207,729 B1 3/2001 Medoff et al.
6,626,678 B2 * 9/2003 Forbes et al. ..... 434/247

OTHER PUBLICATIONS

How to Make Braided Rugs, Dorothy Altpeter et al. 1948, Harper & Brothers.*
Your Rugmaking, Klares Lewes et al., 1949, Sylvan Press, London.*

* cited by examiner

QUILT PATCH BRAIDED RUGS AND METHOD FOR MAKING THE SAME

CROSS-REFERENCE TO RELATED APPLICATIONS

This application claims benefit of U.S. Provisional Patent Application Ser. No. 60/699,592, filed Jul. 15, 2005, which is herein incorporated by reference.

BACKGROUND OF THE INVENTION

1. Field of the Invention

Embodiments of the present invention generally relate to rugs, carpets, and other floor coverings. More specifically, embodiments of the present invention relate to braided rugs and methods for making braided rugs.

2. Description of the Related Art

Crude hand-braided rugs were constructed as early as the $19^{th}$ century. The tradition began with the need to cover bare floors economically with both warmth and beauty. Some of the first braided rugs in America were fashioned from scrap cloth and old clothes. Rugs constructed from wool material are commonly utilized, but these wool rugs are vulnerable to moth damage, lack sufficient durability, and possess other disadvantages.

There is a need for a more durable rug which is not vulnerable to moth damage.

There is a further need for an aesthetically pleasing rug or floor covering which may be reversible.

SUMMARY OF THE INVENTION

Embodiments of the present invention generally include a method for forming a floor covering, comprising providing a first, second, and third section, each section comprising a plurality of jute-like fibers; braiding the first, second, and third sections with one another to form a first braid; and winding the first braid around itself to form a first pattern.

Embodiments of the present invention further include a floor covering, comprising at least one patch, the at least one patch comprising a braid having at least three sections braided together, each section comprising a plurality of jute-like fibers, wherein the braid is wrapped around itself to form the at least one patch.

Further embodiments include a floor covering, comprising an interior patch; and a plurality of quilt-type patches operatively connected to an outer perimeter of the interior patch, wherein the interior patch and quilt-type patches are constructed from braids of jute-type material.

BRIEF DESCRIPTION OF THE DRAWINGS

So that the manner in which the above recited features of the present invention operate can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention involve a method for making braided rugs using jute fibers or jute yarns (or another jute-like material). Embodiments also include a quilt patch braided rug. In general, the rug is made by braiding and stitching jute or jute-like fiber into rectangular mini-rug patches, then stitching the rectangular mini-rug patches together using a thread (for example a poly-cotton thread) to ultimately form a rug which resembles a quilt.

Jute is one of the strongest natural fibers, even being used on sea-going ships prior to the invention of steel cables. Because jute is a reed, it is naturally water-repellent. Its use in rugs and other floor coverings is therefore advantageous because of its durability, strength, and water-repellent quality.

Figure 1:
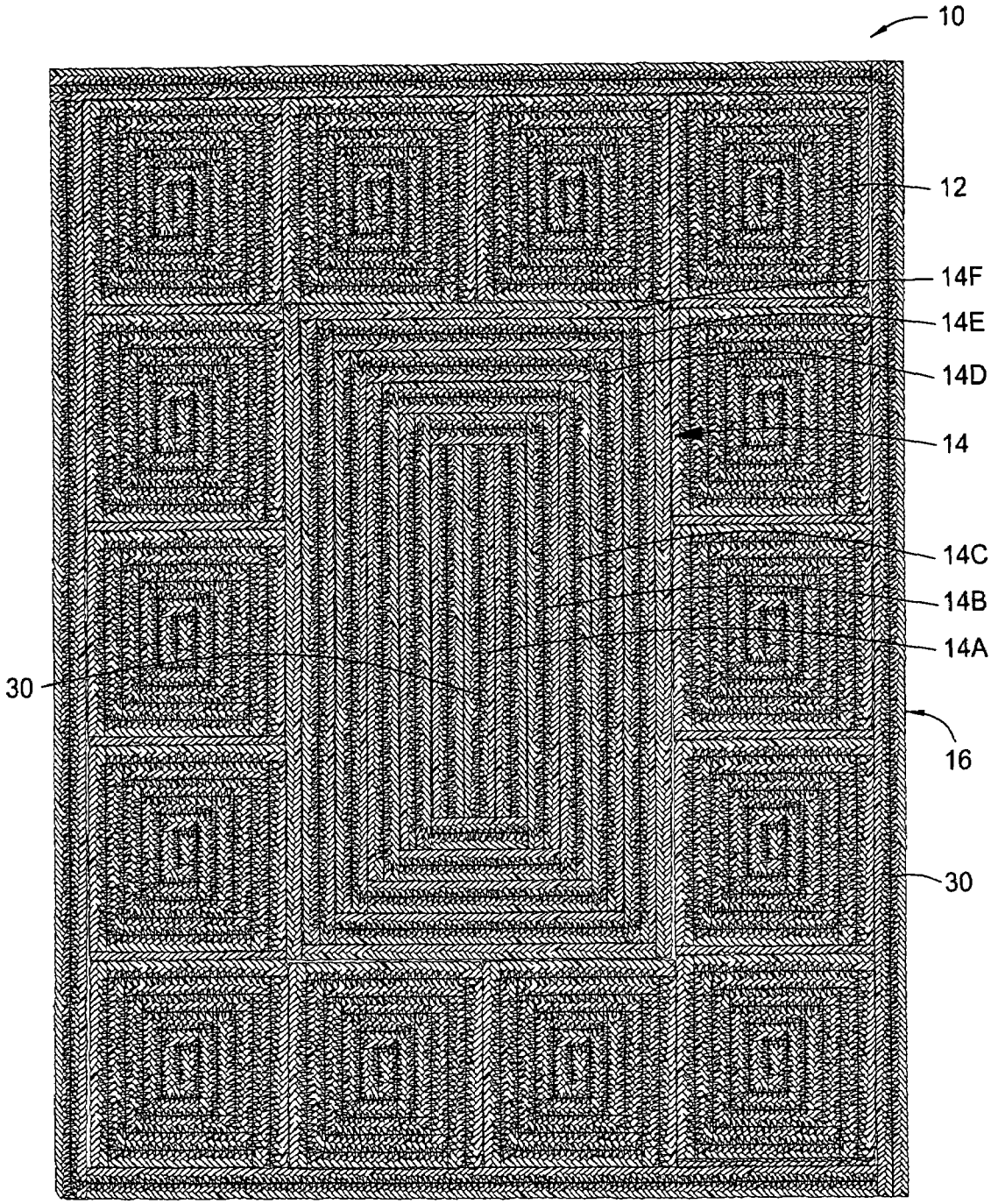
FIG. 1 is a top plan view of an embodiment of a quilt patch braided rug of the present invention.
Figure 2:
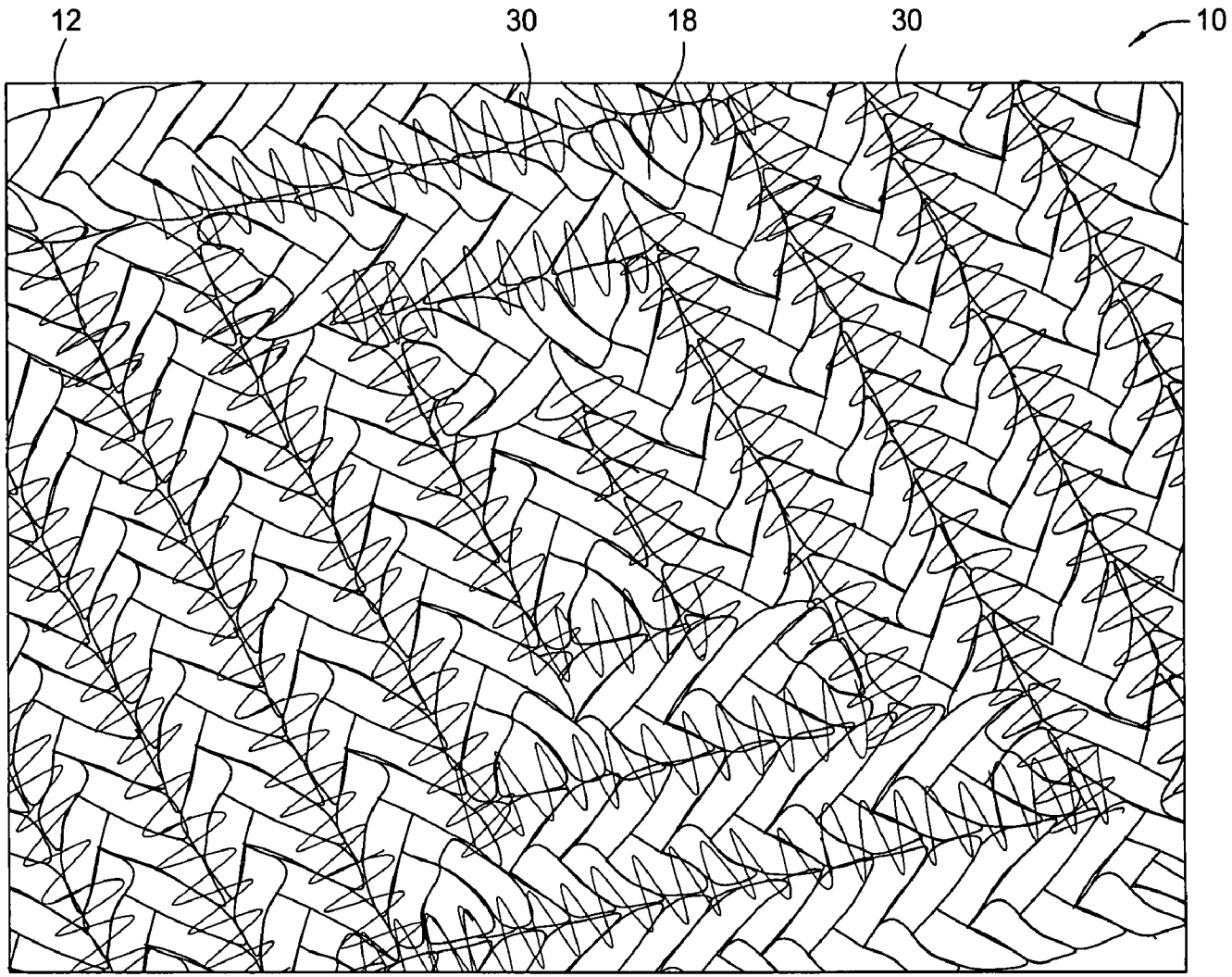
FIG. 2 is a downward close-up perspective view of a portion of the quilt patch braided rug of FIG. 1.

FIGS. 1-2 show an embodiment of a rug 10 constructed from a jute material. The rug 10 includes a plurality of quilt-type patches 12 interconnected to one another, preferably by stitching, most preferably using a poly-cotton thread material.

A preferable design of the rug 10 is shown in FIG. 1. An interior patch 14 is surrounded by the plurality of quilt-type patches 12. The plurality of quilt-type patches 12 are preferably of different, but repeating colors, although any color combination of the quilt-type patches 12 is contemplated for purposes of embodiments of the present invention. In this most preferable design of the rug 10, one or more braids 16 constructed from strands of jute material form the perimeter of the rug 10 by surrounding the outer perimeter of the quilt-type patches 12. Similar to the alternating colors of the quilt-type patches 12, the interior patch 14 is preferably constructed from alternating colors from the center outward. The outer perimeter braid 16 may be constructed from the same colors as a portion of the interior patch 14.

FIG. 2 shows a section of the rug 10 including a quilt-type patch 12. As shown, each quilt-type patch 12 includes a braid 18 formed from a jute or jute-like material. The braid 18 is repeatedly wound around in the desired configuration (here, a square) until the quilt-type patch 12 reaches the desired size and dimensions. Adjacent braids 18 are connected to one another, preferably by a thread material 30, most preferably a poly-cotton thread sewn in a zig-zag pattern.

Figure 3:
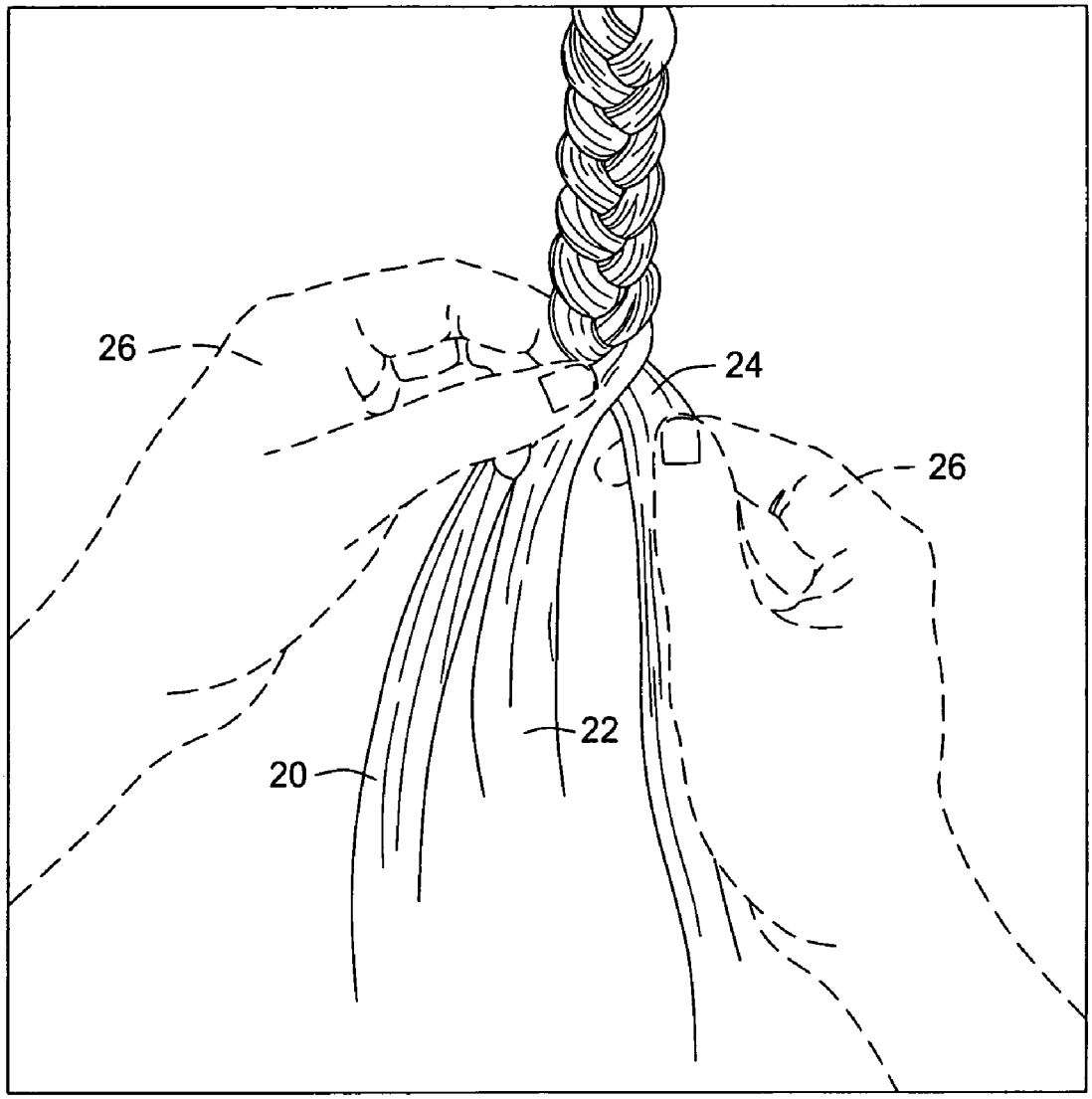
FIG. 3 is a side sectional view of jute or jute-like fibers of a rug of embodiments of the present invention being braided by hand.

In the operation for making the rug 10, as shown in FIG. 3, each braid 16, 18 is formed by providing a first section 20, second section 22, and third section 24, each section 20, 22, 24 including a plurality of strands of jute or jute-like material. It is contemplated for purposes of embodiments of the present invention that these strands of jute material may be of any color, including all of the same color; however, in the most preferable embodiment, each section 20, 22, 24 is a different color to provide an aesthetically-pleasing rug 10. In an alternate embodiment, each section 20, 22, 24 may include strands of different colors therein. FIG. 3 shows the braid 16, 18 being braided by hand 26, but it is within the scope of embodiments of the present invention that the braid 16, 18 may be formed by a machine or other automated or manual method.

Figure 4:
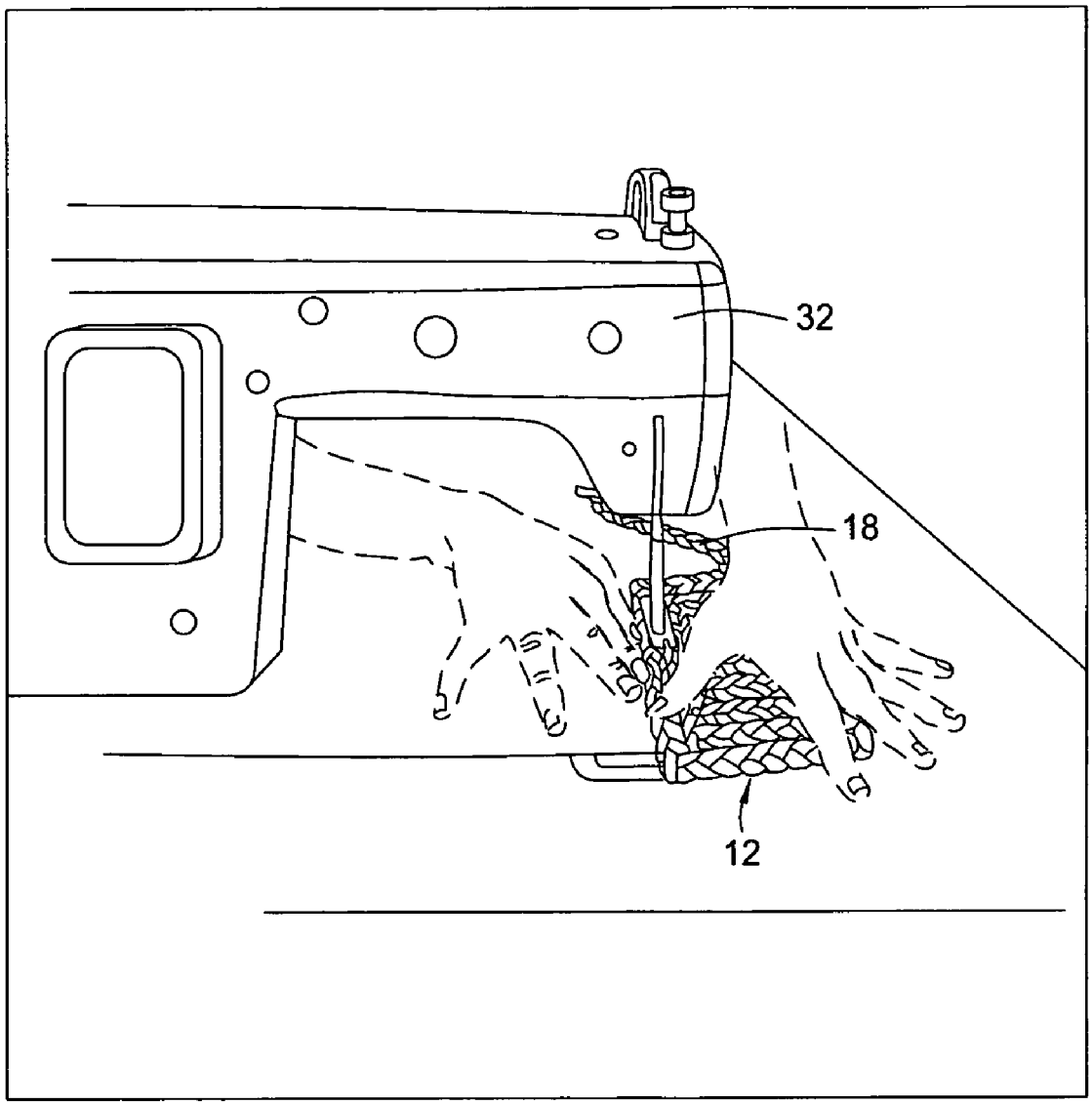
FIG. 4 is a downward perspective view of the jute or jute-like fiber braids of FIG. 3 being sewn to one another into a quilt-type patch.

FIG. 4 shows the next step in the method of forming the rug 10. The braid 18 is wound around itself repeatedly to form the desired shape of the quilt-type patch 12. Most preferably, as shown in FIG. 4, the desired shape is rectangular or square. As the braid 18 is wound around itself, adjacent portions of the braid 18 are connected to one another. Preferably, the adjacent portions of the braid 18 are connected to one another by a thread 30, as shown in FIG. 6, most preferably a poly-cotton thread. Although the thread 30 is capable of being applied to the braid 18 in any pattern, the preferred pattern is zig-zagged to provide a decorative design that maintains the braid 18 in a stable position. The thread 30 may be of any color; however, most preferably, the thread 30 is of a color which matches at least one of the colors within the sections 20, 22, 24.

While the thread 30 may be applied to interconnect adjacent braid 18 portions in any manner, including by stitching by hand or by any other manual or automated method known to those skilled in the art, FIG. 4 illustrates a method of stitching the adjacent braid 18 portions together. As shown, a sewing machine 32 may be utilized to accomplish the stitching.

After formation of the quilt-type patches 12, the quilt-type patches 12 are connected to one another and to any other portions of the rug 10. Again, the quilt-type patches 12 are connected to one another and other portions of the rug 10 (e.g., the interior patch 14 and the perimeter braid 16) preferably by sewing together using a poly-cotton thread 30 of a chosen color.

Although not shown in FIGS. 1-5, it is possible to form a rug 10 constructed entirely of quilt-type patches 12 interconnected to one another, for example with thread 30. In this embodiment, the perimeter braid 16 may optionally be included around the outer perimeter of the outer quilt-type patches 12.

The embodiment shown in FIG. 1 includes the interior patch 14 within the inner perimeter of the arrangement of the plurality of quilt-type patches 12. FIG. 1 illustrates an embodiment of the interior patch 14 having 6 different braids, while other embodiments (not shown) of the interior patch 14 include 5 different braids. As described above, each braid is formed from braiding three sections of jute fibers, each section preferably of a different color.

Specifically, FIG. 1 shows a first center braid 14A, a second braid 14B surrounding an outer perimeter of the first braid 14A, a third braid 14C surrounding an outer perimeter of the second braid 14B, a fourth braid 14D surrounding an outer perimeter of the third braid 14C, and a fifth braid 14E surrounding an outer perimeter of the fourth braid 14D. FIG. 1 shows an additional sixth braid 14F surrounding an outer perimeter of the fifth braid 14E. In alternate embodiments (not shown), only five braids 14A-E are included.

In operation, each braid 14A, 14B, 14C, 14D, 14E, 14F is formed by braiding three sections with one another, each section containing a plurality of jute fiber materials, as described above in relation to the braid 18 of the quilt-type patch 12. Also as described above, each braid 14A, 14B, 14C, 14D, 14E, 14F may be formed of different colors, and each section having the plurality of jute fiber materials may be formed of different colors.

The first braid 14A is wrapped around itself from the center, and adjacent portions of the first braid 14A when wrapped are connected to one another, preferably by the thread 30 as described above in relation to the quilt-type patches 12. The first braid 14A while being wound around itself is sculpted into the preferred shape, which for example is a rectangle as shown in FIG. 1. The second braid 14B is then wrapped around the outer perimeter of the first braid 14A and connected to the first braid 14A, preferably by thread 30. Subsequently, the second braid 14B is wrapped around itself and adjacent portions of the second braid 14B are connected to one another, preferably by the thread 30. The other braids 14C, 14D, 14E, 14F are then wrapped around the outer perimeters of adjacent braids 14B, 14C, 14D, 14E, respectively, and around one another, as well as connected to adjacent braids 14B, 14C, 14D, 14E, respectively, and to one another in the same manner as the second braid 14B. FIG. 1 shows the adjacent braids 14A-F connected to one another by the thread 30.

An outer perimeter of the outer braid 14E (alternate embodiment not shown) or 14F (FIG. 1) is then connected to the inner perimeter of the arrangement of the quilt-type patches 12, preferably by thread 30. The outer perimeter braid 16 is wound around and connected to the outer perimeter of the quilt-type patches 12, preferably by thread 30, then wrapped around itself and connected to adjacent braid portions, preferably by thread 30. FIG. 1 illustrates the interior patch 14, quilt-type patches 12, and outer perimeter braid 16 connected to one another with thread 30.

Figure 5:
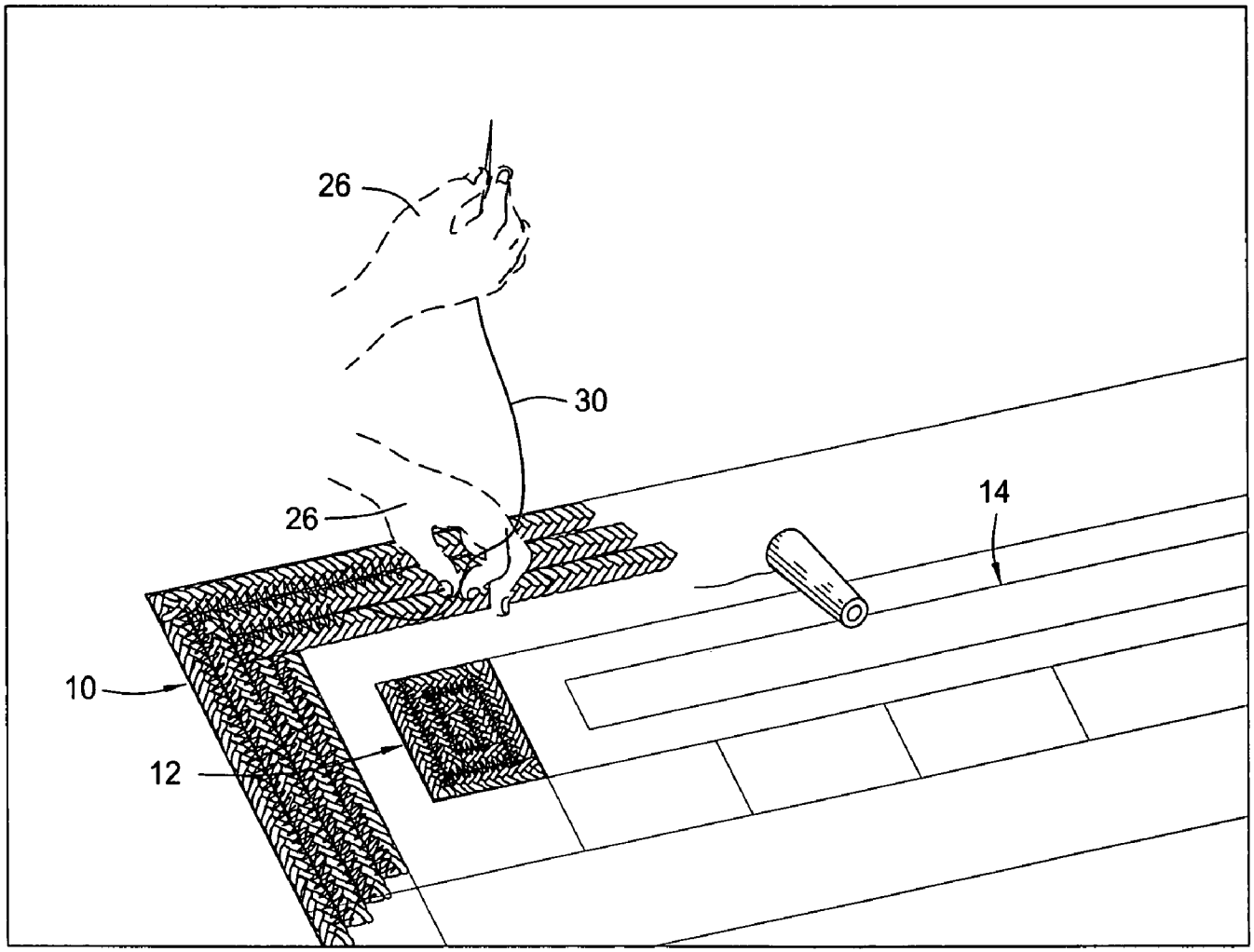
FIG. 5 is a downward perspective view of the quilt-type patch of FIG. 4 being sewn to additional quilt-type patches and other portions of the rug to form the rug.

FIG. 5 illustrates the process of sewing together portions of the rug 10 (interior patch 14, quilt-type patches 12, and outer perimeter braid 16) using thread 30, as described above. Although FIG. 5 shows hand-sewing of the rug portions together, it is within the scope of embodiments of the present invention that the rug portions may be sewn together using a sewing machine or some other manual or automated process.

Exemplary relative lengths, widths, and shapes of each color combination of the braided portions of the interior patch 14 and outer perimeter braid 16 may vary from those of the embodiment shown in FIG. 1. It is, however, contemplated that the relative widths, lengths, and shapes may be of any configuration. Furthermore, any number of braids 14A-F may be included in the interior patch 14, including only one braid or multiple braids.

The quilt-type patches 12 may be provided in 6 different color combinations, each different color combination matching a color combination of a braid 14A-F of the interior patch 14. In the alternate embodiment not shown, the quilt-type patches 12 may be provided in 5 different color combinations, each different color combination matching a color combination of a braid 14A-E of the interior patch 14. Any number of color combinations for the braids 14A-F of the interior patch 14 and for the quilt-type patches 12 is within the scope of embodiments of the present invention. The outer perimeter braid 16 may be constructed from a color combination which is the same as or different from any of the other color combinations of any of the quilt-type patches 12 of any of the braids 14A-F of the interior patch 14.

An advantageous feature of embodiments of the present invention is the reversibility of the rug 10. Preferably, although not necessarily, the rug 10 possesses the same color combination on the first side as on the second side. Accordingly, if the rug 10 becomes dirty or worn on one side, the user may merely flip the rug 10 over to the other side.

In alternate embodiments, when the rug size decreases, the braid sizes may decrease accordingly (and vice versa when the rug size increases). In another alternate embodiment, one or more sections where a quilt-type patch 12 would ordinarily be placed or where any portion of the interior patch 14 would ordinarily be located may be left open for a print design at that location on the rug 10. This location may optionally be filled by stitching a printed patch with a design hand printed, stenciled, or machine-formulated thereon into the open section of the rug 10. The printed patch may be formed from jute or any other material known to those skilled in the art.

Most preferably, the rug is constructed of approximately 100% jute fiber, possibly excluding the stitching which forges the jute fiber braids together (as mentioned above, this stitching is most preferably poly-cotton or another form of polyester or cotton).

Embodiments of the rugs described above are advantageous for several reasons. First, water and other liquids do not affect jute rugs because jute is a reed that grows in water and therefore the jute material is inherently water and liquid repellent, making the rugs usable for kitchens, baths, and entry ways (among other uses). Second, the jute rugs of embodiments of the present invention are easily cleanable, either by cleaning with soap and water, with carpet shampoo or cleaner, or by commercial dry cleaning. Third, the jute rugs of embodiments of the present invention are at least substantially color-fast, capable of retaining the look of fine silk, and moth-proof. Finally, embodiments of the jute rug are comfortable to a person's bare feet, as the feel of the jute rug is similar to natural grass, while the jute rugs remain durable and of long-lasting quality.

Although the description above relates to forming a rug using jute braids, it is within the scope of embodiments of the present invention to use the jute braids and/or patches formed from the jute braids and the method described above to formulate a variety of other products, including but not limited to other floor coverings.

While the foregoing is directed to embodiments of the present invention, other and further embodiments of the invention may be devised without departing from the basic scope thereof, and the scope thereof is determined by the claims that follow.

The invention claimed is:

1. A method for forming a floor covering, comprising:
providing a first, second, and third section, each section comprising a plurality of jute fibers;
braiding the first, second, and third sections with one another to form a first braid, wherein the braiding comprises interweaving the sections together in a diagonally overlapping pattern by placing one section over the other in a regular sequence; and
winding the first braid around itself to form a first pattern.

2. The method of claim 1, wherein the first pattern is rectangular.

3. The method of claim 1, further comprising operatively connecting adjacent portions of the braid to one another.

4. The method of claim 3, wherein operatively connecting adjacent portions of the braid to one another is accomplished by sewing the adjacent portions together.

5. The method of claim 1, further comprising:
forming a second braid; and
winding the second braid around itself to form a second pattern.

6. The method of claim 5, further comprising operatively connecting the first pattern and the second pattern.

7. The method of claim 1, further comprising:
forming a third braid; and
winding the third braid around the first braid in conformance with the first pattern.

8. The method of claim 7, further comprising operatively connecting adjacent portions of the third braid together and operatively connecting an outer perimeter of the first braid to an inner perimeter of the third braid.

9. The method of claim 8, wherein the first and third braids are rectangular.

10. The method of claim 1, wherein the first pattern is formed when outer perimeters of adjacent abutting portions of the first braid directly contact one another.

11. A floor covering, comprising:
at least one pattern, the at least one pattern comprising:
a braid having at least three sections braided together, each section comprising a plurality of jute fibers, the at least three sections braided together by interweaving the at least three sections together in a diagonally overlapping pattern by placing one section over the other in a regular sequence,
wherein the braid is wrapped around itself to form the at least one pattern.

12. The floor covering of claim 11, wherein adjacent portions of the braid are connected to one another to form the at least one pattern.

13. The floor covering of claim 11, wherein the pattern further comprises thread sewn to operatively connect adjacent portions of the wrapped braid.

14. The floor covering of claim 11, wherein each section is a different color.

15. The floor covering of claim 11, wherein the at least one pattern is connected to an additional pattern.

16. The floor covering of claim 15, wherein the additional pattern comprises:
an additional braid having at least three sections braided together, each section comprising a plurality of jute fibers,
wherein the additional braid is wrapped around itself to form the additional pattern.

17. The floor covering of claim 11, wherein the at least one pattern further comprises outer perimeters of adjacent abutting portions of the braid directly contacting one another.

18. The floor covering of claim 11, each section consisting of jute fibers.

19. A floor covering, comprising:
an interior patch; and
one or more additional patches operatively connected to an outer perimeter of the interior patch, wherein the interior patch and one or more additional patches are constructed from braids of jute material.

20. The floor covering of claim 19, further comprising an outer perimeter braid operatively connected to an outer perimeter of the one or more additional patches.

21. The floor covering of claim 19, wherein the interior patch includes a plurality of interconnected braids.

22. The method of claim 19, wherein the one or more additional patches comprise a plurality of rectangular patches.

23. A method for forming a floor covering, comprising:
providing a first, second, and third section, each section comprising a plurality of jute fibers;
braiding the first, second, and third sections with one another to form a first braid;
winding the first braid around itself to form a first pattern;
forming a second braid;
winding the second braid around itself to form a second pattern; and
operatively connecting the first pattern and the second pattern.

24. The method of claim 23, wherein the first and second patterns are square.

25. The method of claim 23, wherein the first and second patterns are rectangular.

26. A floor covering, comprising:

a first pattern, the first pattern comprising:

a first braid having at least three sections braided together, each section comprising a plurality of jute fiber strands, the at least three sections braided together by interweaving the at least three sections together in a diagonally overlapping pattern by placing one section over the other in a regular sequence, wherein the first braid is wrapped around itself to form the first pattern; and a second pattern operatively connected to the first pattern, the second pattern comprising:

a second braid having at least three sections braided together, each section comprising a plurality of fiber strands, the at least three sections braided together by interweaving the at least three sections together in a diagonally overlapping pattern by placing one section over the other in a regular sequence, wherein the second braid is wrapped around itself to form the second pattern.

* * * * *